US008733854B1

(12) United States Patent
Chang

(10) Patent No.: US 8,733,854 B1
(45) Date of Patent: May 27, 2014

(54) CABINET WITH ELECTRICAL LOCKS

(71) Applicant: Ting-Yu Chang, Taichung (TW)

(72) Inventor: Ting-Yu Chang, Taichung (TW)

( * ) Notice: Subject to any disclaimer, the term of this patent is extended or adjusted under 35 U.S.C. 154(b) by 0 days.

(21) Appl. No.: 13/738,253

(22) Filed: Jan. 10, 2013

(51) Int. Cl.
*E05B 65/46* (2006.01)

(52) U.S. Cl.
USPC ..... 312/217; 312/218; 312/107.5

(58) Field of Classification Search
CPC ..... E05B 65/46; E05B 65/462; E05B 65/463
USPC ..... 312/215, 216, 217, 218, 219, 220, 221, 312/107.5, 222; 70/78–81, 85; 292/DIG. 18
See application file for complete search history.

(56) References Cited

U.S. PATENT DOCUMENTS 1,552,511 A * 9/1925 Secoy ..... 312/221
5,862,689 A * 1/1999 Wen ..... 70/85
6,347,848 B1 * 2/2002 Cho ..... 312/219
6,722,167 B1 * 4/2004 Hsu ..... 70/78
7,144,092 B1 * 12/2006 Chang ..... 312/217
7,264,319 B2 * 9/2007 Cheng ..... 312/220
7,946,663 B2 * 5/2011 Holcomb ..... 312/218
2006/0066187 A1 * 3/2006 Chang ..... 312/219
2006/0197416 A1 * 9/2006 Tsai ..... 312/217
2007/0035218 A1 * 2/2007 Chen et al. ..... 312/221
2007/0278913 A1 * 12/2007 Liu ..... 312/220
2008/0279490 A1 * 11/2008 Holcomb ..... 384/42

* cited by examiner

*Primary Examiner* — Daniel Rohrhoff

(57) ABSTRACT

A cabinet with electrical locks forms a first through hole larger than a diameter of a horizontal rod for manually lifting a longitudinal track to unlock. A second through hole larger than a diameter of a pivoting arm for lifting the longitudinal track mechanically is also formed. Thereby, the first and the second through holes provide excess space for the horizontal rod and the pivoting arm, so the horizontal rod and the pivoting arm may not interfere each other when driven to lift the longitudinal track up. Thus, the pivoting arm may not be damaged when the longitudinal track is lifted manually.

4 Claims, 7 Drawing Sheets

CABINET WITH ELECTRICAL LOCKS

BACKGROUND OF THE INVENTION

1. Field of the Invention

The present invention relates to a cabinet with electrical locks.

2. Description of the Prior Art

A conventional cabinet with drawers having locking mechanisms including manual mode and electrical mode is disclosed in TW 1262980 or U.S. Pat. No. 6,116,067. Generally, the cabinet has a longitudinal track which is able to move up and down for locking or unlocking the drawers, and a manual lifting mechanism and an electrical lifting mechanism are connected with the longitudinal track respectively to be utilized to lift the longitudinal track up for unlocking the drawers.

However, when one of the manual lifting mechanism or the electrical lifting mechanism is utilized, the other one of the manual lifting mechanism or the electrical lifting mechanism may be lifted too. Thus, the electrical lifting mechanism including motor may be damaged. In other words, the electrical lifting mechanism may be damaged when being lifted forcedly.

SUMMARY OF THE INVENTION

The main object of the present invention is to provide a cabinet with electrical locks having a better-designed locking mechanism which is able to be unlocked and locked by electrical means and manually.

To achieve the above and other objects, a cabinet with electrical locks of the present invention comprises a case, a locking mechanism, a horizontal rod, and an electric mechanism.

The case has a receiving room and an opening which communicates with the receiving room and faces forward, and the receiving room is adapted for receiving at least one drawer wherein the drawer forms a positioning portion extending from a rear end thereof. The positioning portion has a buckle portion at an end. The drawer is able to slide back and forth and to be exposed from the opening.

The locking mechanism includes a longitudinal track which is able to move up and down between a first position and a second position. A longitudinal axis is defined by the first position to the second position. The longitudinal track is disposed at an end of the case opposite to the opening, and the longitudinal track has a cavity therein to be hollow and forms at least one locking hole at a face thereof facing the drawer. The locking hole is adapted for the positioning portion to insert therein and communicates with the cavity. The longitudinal track forms a first through hole at a top thereof and a second through hole at a lateral side thereof. A length of the first through hole along the longitudinal axis is larger than a distance between the first position and the second position, and a length of the second through hole along the longitudinal axis is larger than the distance between the first position and the second position.

An end of the horizontal rod is connected with a driving element which is able to rotate the horizontal rod, and an opposite end of the horizontal rod is inserted through the first through hole. A portion of the horizontal rod positionally corresponding to the first through hole has a lifting portion.

The electric mechanism has a control panel electrically connected with a power supply and a lock controller. The lock controller further has a pivoting arm extending therefrom.

The pivoting arm is inserted through the second through hole and is able to pivot with respect to the lock controller.

In use, when the longitudinal track is located at the first position which is lower, the buckle portion is located inside the cavity and is deviated from the locking hole so that the drawer is positioned and is unable to be moved toward the opening. At this time, the lifting portion is located at an upper end of the first through hole, and the pivoting arm is located at an upper end of the second through hole.

On the contrary, the longitudinal track is able to be lifted to the second position for unlocking the drawer from the first position by the pivoting arm which is driven to pivot by the lock controller driven by the control panel. Also, when the driving element triggers the horizontal rod to rotate, the horizontal rod drives the lifting portion to rotate so as to lift the longitudinal track from the first position to the second position to unlock the drawer. Thereby, when the longitudinal track is located at the second position, the buckle portion positionally corresponds to the locking hole and is able to leave the longitudinal track via the locking hole so that the drawer is able to be moved toward the opening.

Thereby, the drawer can be unlocked or locked by one of the electrically-driving mode and the manual mode which not interrupt each other. Thus, the pivoting arm may not be damaged when the longitudinal track is lifted by the horizontal rod.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
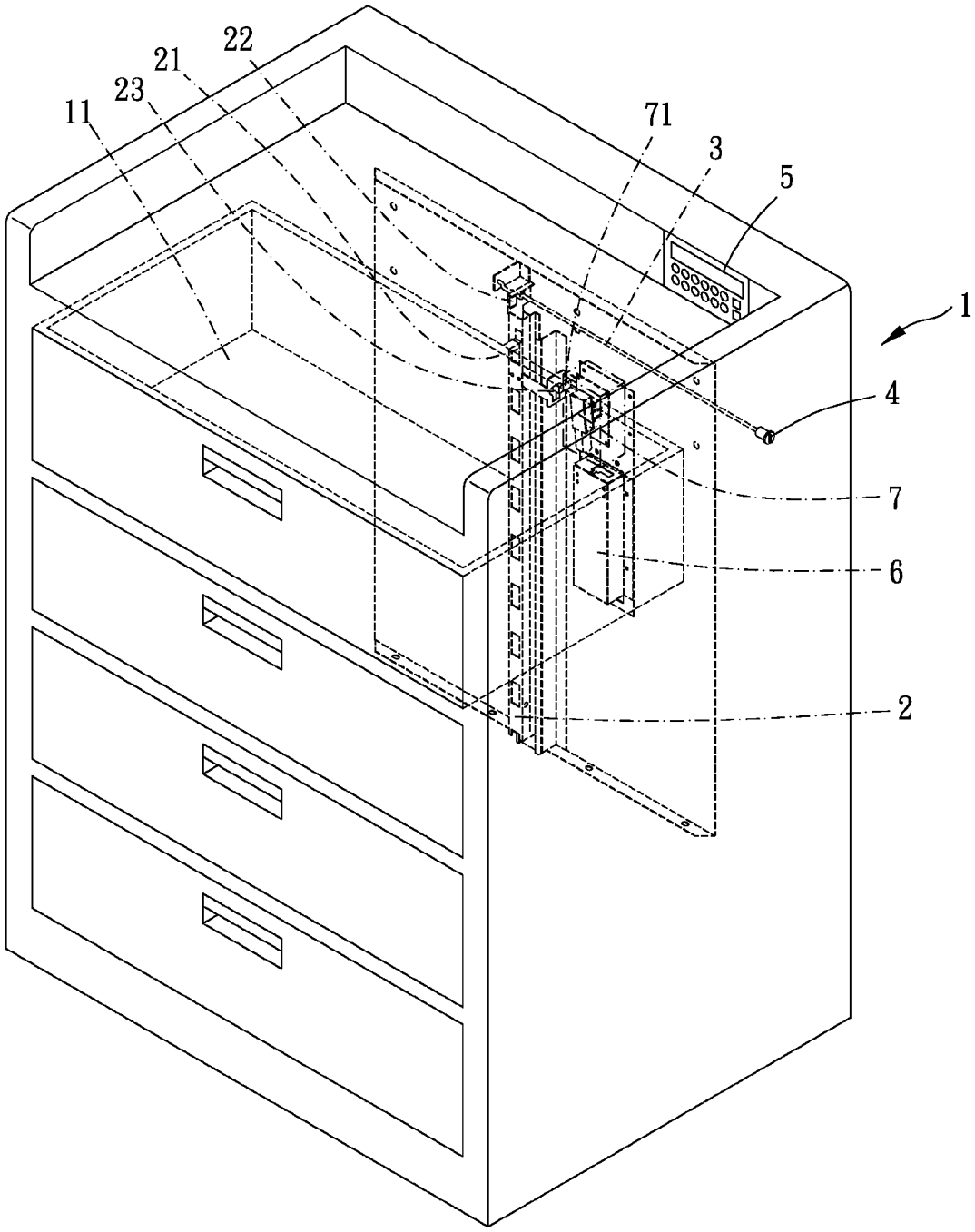
FIG. 1 is a perspective drawing of the present invention.
Figure 2:
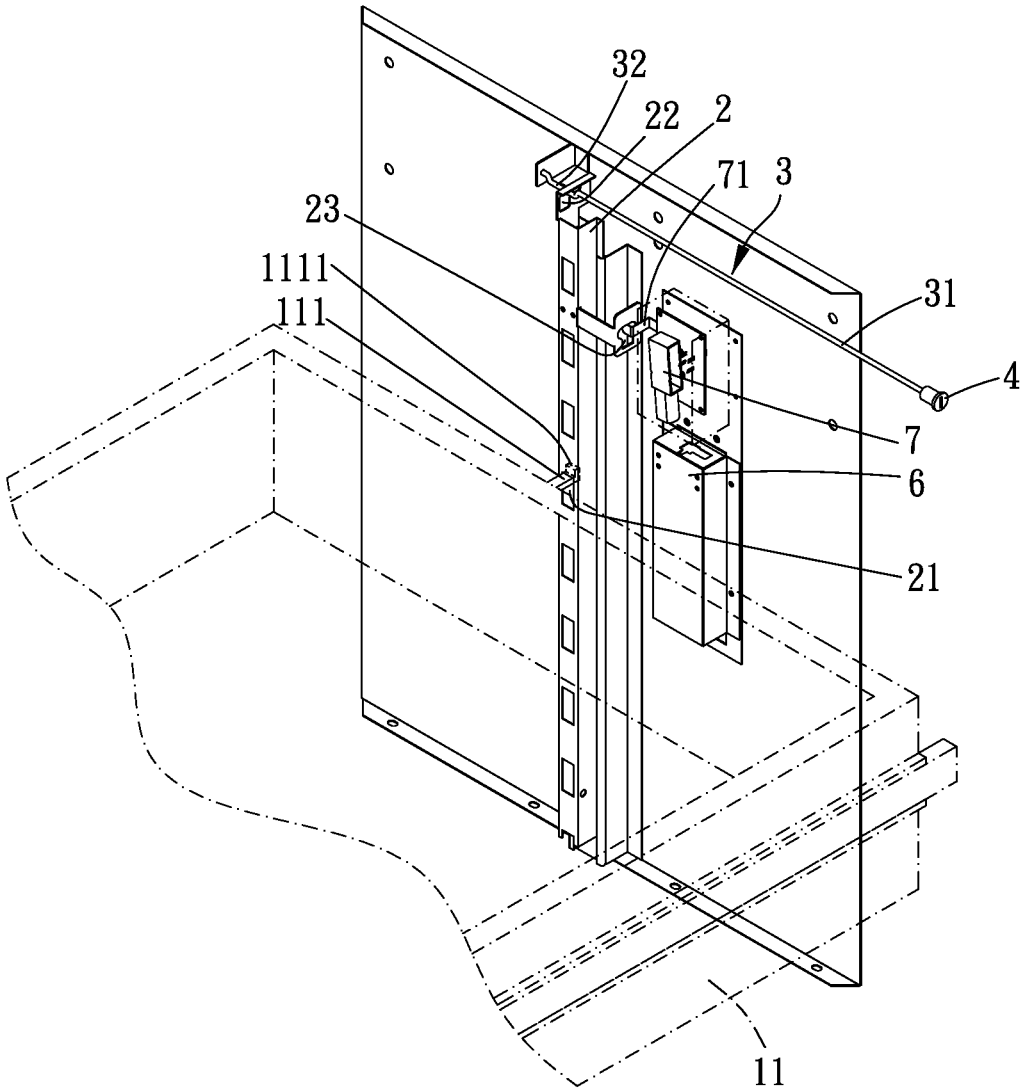
FIG. 2 is an illustration of the present invention when the longitudinal track is located at the first position.
Figure 3:
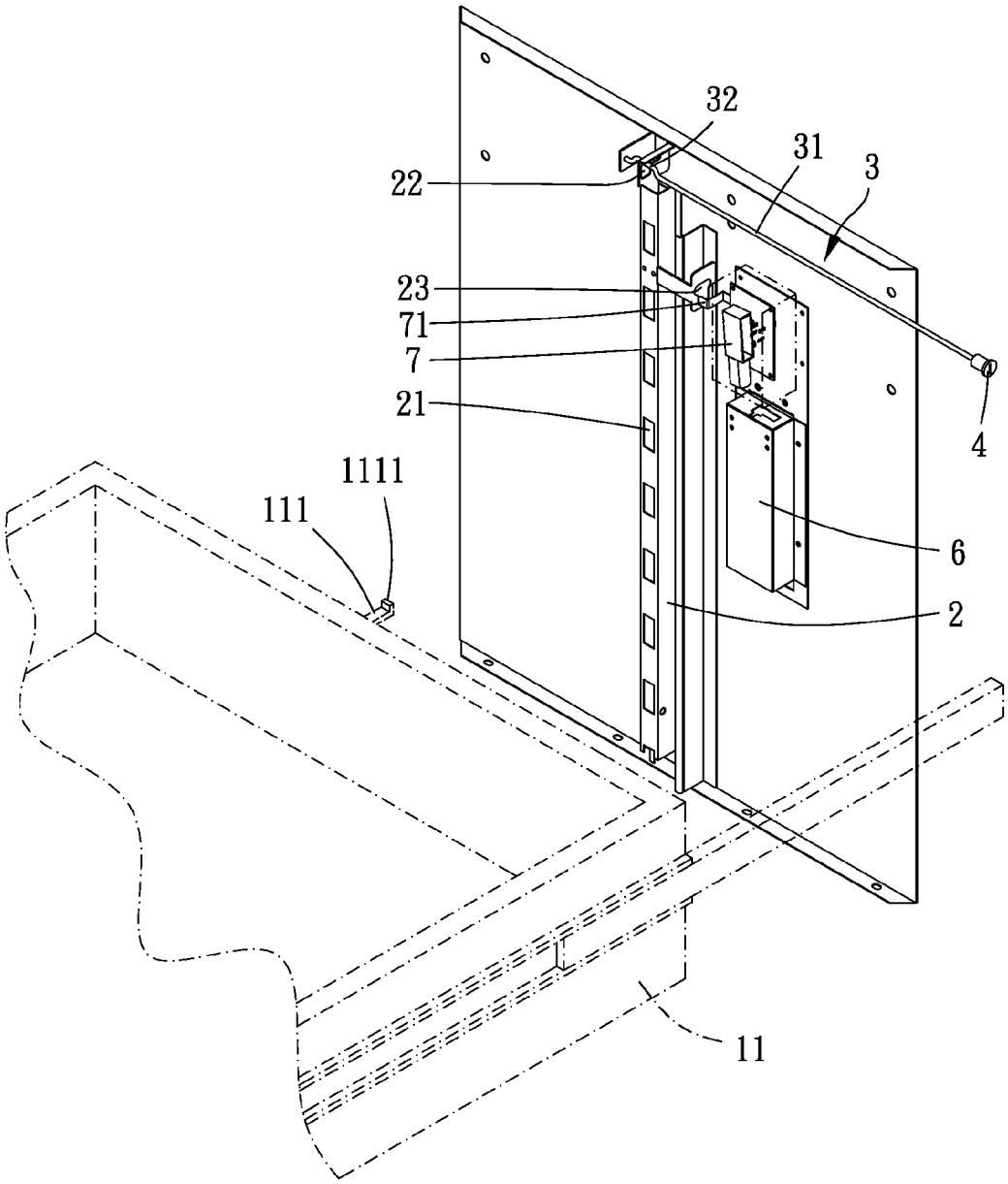
FIG. 3 is an illustration of the present invention when the longitudinal track is located at the second position in a manual mode.
Figure 4:
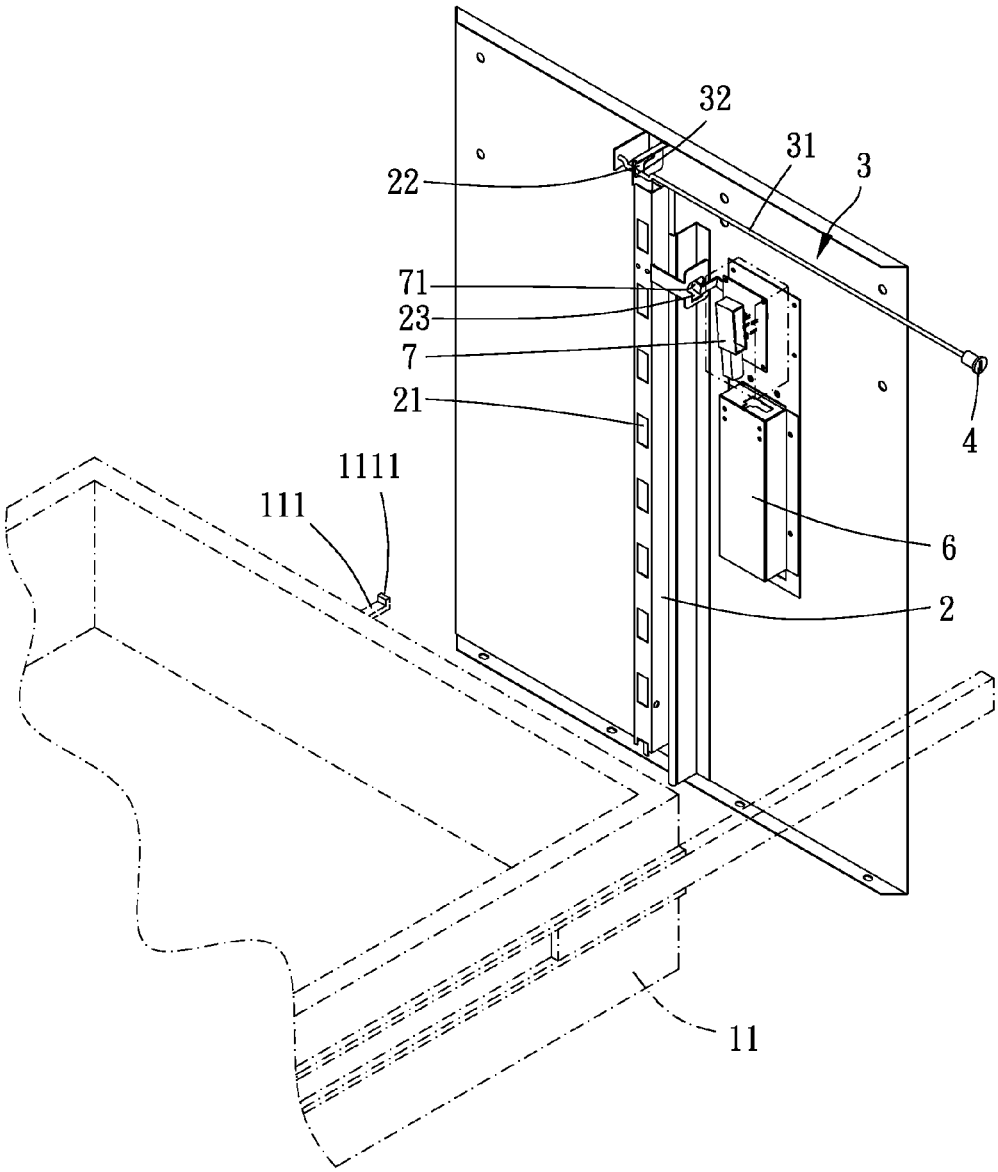
FIG. 4 is an illustration of the present invention when the longitudinal track is located at the second position in an electrically-driving mode.
Figure 5:
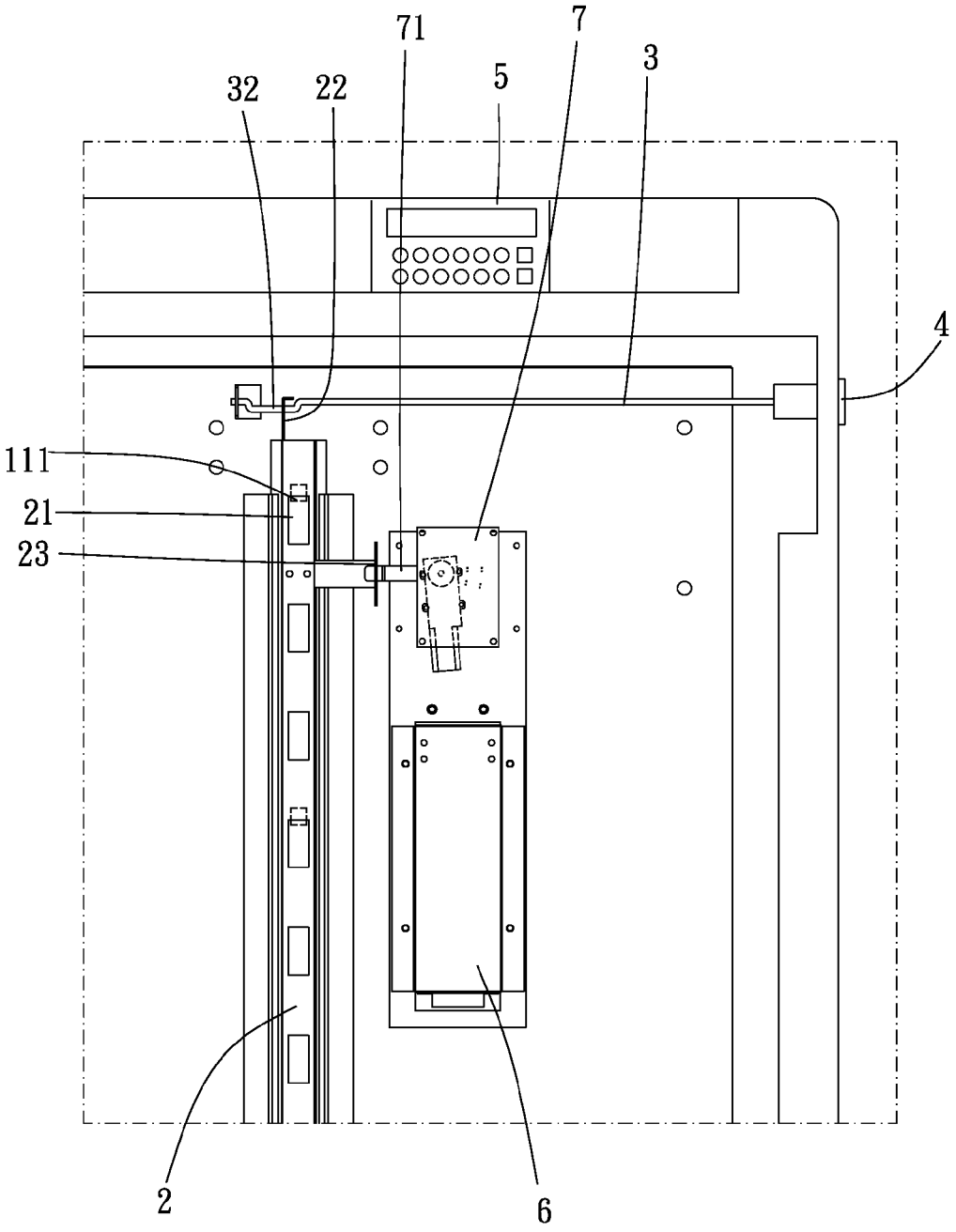
FIG. 5 is a partial profile of the present invention when the longitudinal track is located at the first position.
Figure 6:
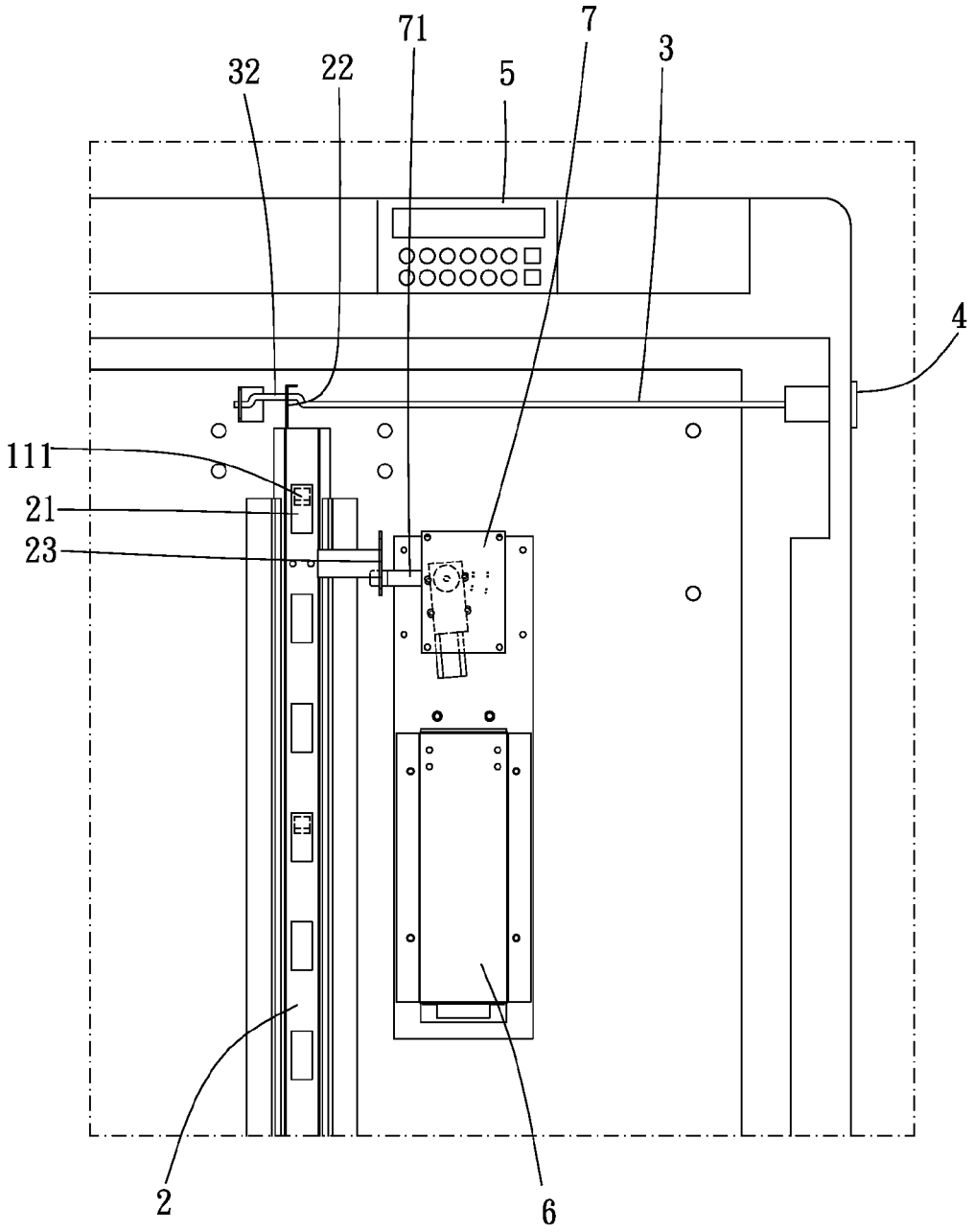
FIG. 6 is a partial profile of the present invention when the longitudinal track is located at the second position in a manual mode.
Figure 7:
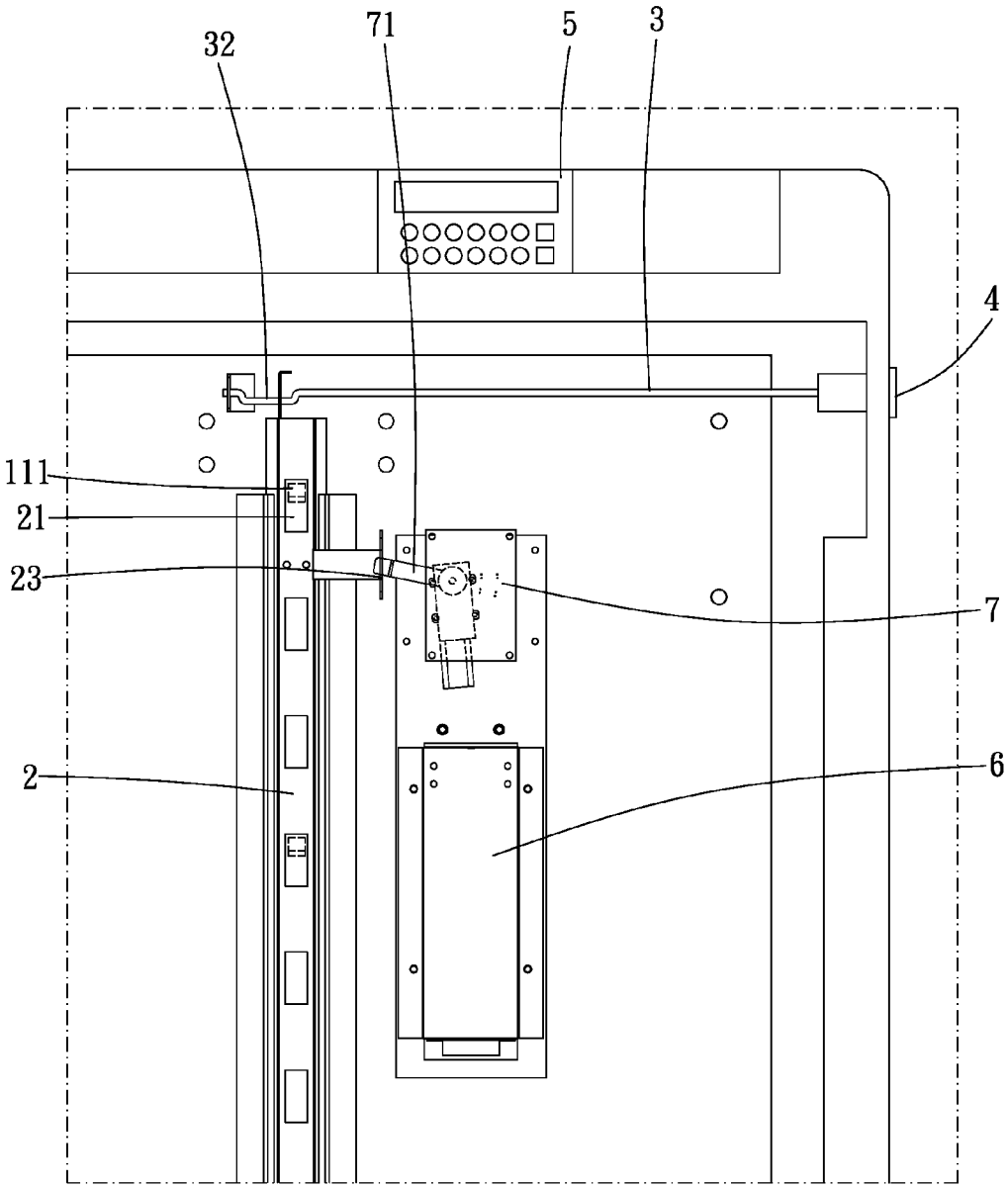
FIG. 7 is a partial profile of the present invention when the longitudinal track is located at the second position in an electrically-driving mode.

Please refer to FIG. 1 to FIG. 7, the cabinet with electrical locks of the present invention comprises a case 1, a locking mechanism, a horizontal rod 3, and an electric mechanism.

The case 1 has a receiving room and an opening which communicates with the receiving room and faces forward. In other words, the opening is formed at a front side of the case 1. The receiving room is adapted for receiving at least one drawer 11 which forms a positioning portion 111 extending from a rear end thereof. The positioning portion 111 has a buckle portion 1111 at an end. In the present embodiment, the buckle portion 1111 extends from the positioning portion 111 vertically. The drawer 11 is able to slide back and forth and to be exposed from the opening. In practice, the drawer 11 can be slidably disposed to the case 1 by conventional sliding tracks or other possible means.

The locking mechanism includes a longitudinal track 2 which is able to move up and down between a first position and a second position. A longitudinal axis is defined by the first position to the second position. The longitudinal track 2 is disposed at an end of the case 1 opposite to the opening. The longitudinal track 2 has a cavity therein to be hollow and forms at least one locking hole 21 at a face thereof facing the drawer 11. The locking hole 21 is adapted for the positioning portion 111 to insert therein and communicates with the cavity. In the present embodiment, the longitudinal track 2 forms a plurality of locking holes 21 spacedly arranged along the longitudinal axis. The locking holes 21 are adapted for a plurality of drawers 11 to be locked thereto. On the other hand, the longitudinal track 2 forms a first through hole 22 at a top thereof and a second through hole 23 at lateral side thereof. Specifically, a length of the first through hole 22 along the longitudinal axis is larger than a distance between the first position and the second position, and a length of the second through hole 23 along the longitudinal axis is larger than the distance between the first position and the second position.

The horizontal rod 3 is connected with a driving element 4 with an end wherein the driving element 4 is able to rotate the horizontal rod 3. In the present embodiment, the driving element 4 is a rotate switch. An opposite end of the horizontal rod 3 is inserted through the first through hole 22, and a portion of the horizontal rod 3 positionally corresponding to the first through hole 22 has a lifting portion. In the present embodiment, the horizontal rod 3 has a bent section 32 and two straight sections 31 which are connected to two ends of the bent section 32 respectively. The bent section 32 forms the lifting portion. Specifically, a central axis of the bent section 32 is deviated from and parallel to a central axis of each straight section 31 so that the bent section 32 is reversed-U-shaped. In normal state, the bent section 32 faces forward, rearward, or downward. When the horizontal rod 3 is rotated and the bent section 32 faces upward, the longitudinal track 2 is lifted up by the bent section 32.

The electric mechanism has a control panel 5 electrically connected with a power supply 6 and a lock controller 7. In the present invention, the control panel 5 has an IC board adapted for passwords settings and time settings. The lock controller 7 has a pivoting arm 71 extending therefrom. The pivoting arm 71 is inserted through the second through hole 23 and is able to pivot with respect to the lock controller 7.

In use, the drawer 11 can be locked or unlocked manually or by electrical means.

First, when the longitudinal track 2 is located at the second position which is lower than the first position, the buckle portion 1111 is located inside the cavity and is deviated from the locking hole 21 so that the drawer 11 is positioned and is unable to be moved toward the opening. At this time, the lifting portion is located at an upper end of the second through hole 23, and the pivoting arm 71 is located at an upper end of the second through hole 23. Specifically, the bent section 32 of the horizontal rod 3 faces forward, rearward, or downward. Thereby, the drawer 11 is locked.

Second, when the drawer 11 is to be unlocked by electrical means, a user can utilize the control panel 5. When a correct password is entered into the control panel 5 or current time corresponds to a predetermined time, the control panel 5 triggers the lock controller 7 to drive the pivoting arm 71 to pivot upward. Thereby, the longitudinal track 2 may be lifted up to the second position by the pivoting arm 71, and the buckle portion 1111 positionally corresponds to the locking hole 21. Thus, the drawer 11 is unlocked and is able to be moved toward the opening. At this time, the lifting portion is located at a lower portion of the first through hole 22.

Third, when electricity is cut or the electric mechanism is out of function, a user can utilize the driving element 4 to rotate the horizontal rod 3. When the lifting portion is rotated, the lifting portion is able to lift the longitudinal track 2 up to the second position from the first position. Specifically, the bent section 32 of the horizontal rod 3 faces upward to push the longitudinal track 2 upward. Thereby, the drawer 11 is unlocked and is able to be moved toward the opening. At this time, the pivoting arm 71 is located at a lower portion of the second through hole 23.

As a result, the drawer can be unlocked by two ways, and the lifted longitudinal track by the lifting portion may not pull the pivoting arm upward to damage it. Also, the lifted longitudinal track by the pivoting arm may not pull the lifting portion upward too. In other words, the two mechanisms to unlock the drawer may not interfere each other, so the components may not be damaged or broken.

What is claimed is:

1. A cabinet with electrical locks, comprising:

a case, having a receiving room and an opening which communicates with the receiving room and faces forward, the receiving room being adapted for receiving at least one drawer, the drawer forming a positioning portion extending from a rear end thereof, the positioning portion having a buckle portion at an end, the drawer being able to slide back and forth and to be exposed from the opening;

a locking mechanism, including a longitudinal track which is able to move up and down between a first position and a second position, a longitudinal axis being defined by the first position to the second position, the longitudinal track being disposed at an end of the case opposite to the opening, the longitudinal track having a cavity therein to be hollow and forming at least one locking hole at a face thereof facing the drawer, the locking hole being adapted for the positioning portion to insert therein, the locking hole communicating with the cavity, the longitudinal track forming a first through hole at a top thereof and a second through hole at a lateral side thereof, a length of the first through hole along the longitudinal axis being larger than a distance between the first position and the second position, a length of the second through hole along the longitudinal axis being larger than the distance between the first position and the second position;

a horizontal rod, an end of the horizontal rod being connected with a driving element which is able to rotate the horizontal rod, an opposite end of the horizontal rod being inserted through the first through hole, a portion of the horizontal rod positionally corresponding to the first through hole having a lifting portion;

an electric mechanism, having a control panel, the control panel being electrically connected with a power supply and a lock controller, the lock controller further having a pivoting arm extending therefrom, the pivoting arm being inserted through the second through hole and being able to pivot with respect to the lock controller;

wherein when the longitudinal track is located at the first position which is lower, the buckle portion is located inside the cavity and is deviated from the locking hole so that the drawer is positioned and is unable to be moved toward the opening, the lifting portion is located at an upper end of the first through hole, the pivoting arm is located at an upper end of the second through hole;

wherein the longitudinal track is able to be lifted to the second position from the first position by the pivoting arm which is driven to pivot by the lock controller driven by the control panel;

wherein when the driving element triggers the horizontal rod to rotate, the horizontal rod drives the lifting portion to rotate so as to lift the longitudinal track from the first position to the second position;

wherein when the longitudinal track is located at the second position, the buckle portion positionally corresponds to the locking hole and is able to leave the longitudinal track via the locking hole so that the drawer is able to be moved toward the opening.

2. The cabinet with electrical locks of claim 1, wherein the horizontal rod has a bent section and two straight sections which are connected to two ends of the bent section respectively, the bent section forms the lifting portion, a central axis of the bent section is deviated from a central axis of each straight section so that the bent section is reversed-U-shaped.

3. The cabinet with electrical locks of claim 1, wherein the driving element is a rotate switch.

4. The cabinet with electrical locks of claim 1, wherein the control panel has an IC board adapted for passwords settings and time settings.

* * * * *